US012575711B2

(12) United States Patent
Friedke et al.

(10) Patent No.: US 12,575,711 B2
(45) Date of Patent: Mar. 17, 2026

(54) DOMESTIC DISHWASHER

(71) Applicant: BSH Hausgeräte GmbH, Munich (DE)

(72) Inventors: Aaron Friedke, Gundelfingen (DE); Daniel Miller, Dillingen (DE); Michael Rupp, Holzheim (DE); Manuel Jörg, Lauingen (DE)

(73) Assignee: BSH Hausgeräte GmbH, Munich (DE)

( * ) Notice: Subject to any disclaimer, the term of this patent is extended or adjusted under 35 U.S.C. 154(b) by 173 days.

(21) Appl. No.: 18/579,523

(22) PCT Filed: Jul. 7, 2022

(86) PCT No.: PCT/EP2022/068852
§ 371 (c)(1),
(2) Date: Jan. 16, 2024

(87) PCT Pub. No.: WO2023/285264
PCT Pub. Date: Jan. 19, 2023

(65) Prior Publication Data

US 2024/0315527 A1 Sep. 26, 2024

(30) Foreign Application Priority Data

Jul. 16, 2021 (DE) ..... 102021207587.8

(51) Int. Cl.
*A47L 15/50* (2006.01)
*A47L 15/42* (2006.01)

(52) U.S. Cl.
CPC ..... *A47L 15/507* (2013.01); *A47L 15/4257* (2013.01); *A47L 2501/22* (2013.01)

(58) Field of Classification Search
CPC . A47L 15/507; A47L 2501/22; A47L 15/4257
See application file for complete search history.

(56) References Cited

U.S. PATENT DOCUMENTS 10,422,176 B2 * 9/2019 Carli ..... E05F 15/611
2022/0322911 A1 * 10/2022 Friedke ..... A47L 15/4259

FOREIGN PATENT DOCUMENTS

| | | | | |
|---|---|---|---|---|
| CN | 213405938 U | * | 6/2021 | |
| CN | 215383821 U | * | 1/2022 | |
| CN | 215650934 U | * | 1/2022 | |
| CN | 215687615 U | * | 2/2022 | |
| DE | 102017114984 A1 | | 1/2018 | |
| DE | 102017201223 A1 | | 7/2018 | |
| DE | 102018130699 A1 | | 6/2020 | |
| EP | 1886616 A2 | * | 2/2008 | ..... A47L 15/507 |
| EP | 2465407 A2 | * | 6/2012 | ..... A47L 15/507 |

(Continued)

OTHER PUBLICATIONS

National Search Report DE 10 2021 207 587.8 dated May 19, 2022.
International Search Report PCT/EP2022/068852 dated Oct. 7, 2022.

*Primary Examiner* — Benjamin L Osterhout
(74) *Attorney, Agent, or Firm* — Michael E. Tschupp; Andre Pallapies; Brandon G. Braun

(57) ABSTRACT

A household dishwasher includes a dishwasher cavity, a door designed to close off or open the dishwasher cavity, a receptacle for an item to be washed, and a drive designed to move the receptacle in a deployment direction to at least partially open the door and/or a retraction direction to at least partially close the door.

15 Claims, 5 Drawing Sheets

(56) References Cited

FOREIGN PATENT DOCUMENTS

| | | | | | |
|---|---|---|---|---|---|
| EP | 3881749 | A1 | * | 9/2021 | ..... F24C 15/023 |
| EP | 3967934 | A1 | * | 3/2022 | ..... F24C 15/162 |
| KR | 100818910 | B1 | | 4/2008 | |
| KR | 20210014941 | A | * | 2/2021 | ..... A47L 15/507 |
| WO | 2007048544 | A1 | | 5/2007 | |
| WO | WO-2019021596 | A1 | * | 1/2019 | ..... A47L 15/46 |
| WO | WO-2020117515 | A1 | * | 6/2020 | ..... A47L 15/0084 |

* cited by examiner

DOMESTIC DISHWASHER

CROSS-REFERENCES TO RELATED APPLICATIONS

This application is the U.S. National Stage of International Application No. PCT/EP2022/068852, filed Jul. 7, 2022, which designated the United States and has been published as International Publication No. WO 2023/285264 A1 and which claims the priority of German Patent Application, Serial No. 10 2021 207 587.8, filed Jul. 16, 2021, pursuant to 35 U.S.C. 119(a)-(d).

The contents of International Application No. PCT/EP2022/068852 and German Patent Application, Serial No. 10 2021 207 587.8 are incorporated herein by reference in their entireties as if fully set forth herein.

BACKGROUND OF THE INVENTION

The present invention relates to a household dishwasher.

The operation of household dishwashers is intended to be increasingly simplified. To this end, it is known from the publications EP 2 568 864 B1 and DE 10 2005 010 616 A1, for example, to provide a household dishwasher with a drive. The drive is set up to move a rack automatically. Moreover, apparatuses for automatic door opening in a household dishwasher are disclosed in the publications EP 2 797 478 B1, EP 2 568 864 B1 and EP 2 371 258 A2.

BRIEF SUMMARY OF THE INVENTION

The object of the present invention is to provide an improved household dishwasher.

Accordingly a household dishwasher is provided with a dishwasher cavity, a door for closing off or for opening the dishwasher cavity, a receptacle for items to be washed and a drive. The drive is set up to move the receptacle for items to be washed in a deployment direction and/or a retraction direction in such a way that it at least partially opens and/or closes the door.

Drives for the automatic, in particular motorized, movement of a receptacle for items to be washed are known from the prior art, as described in the introduction. Advantageously, this drive is used in operative connection with the receptacle for items to be washed in order to open and/or close the door. As a result, an additional mechanism for opening the door is dispensed with or such a mechanism can be simplified.

The door can be opened partially or fully. The door is thus displaced by means of the receptacle for items to be washed, which is driven by the drive, into an at least partially open position or out of such a position into its closed position. An opening angle of the door in its partially open position can be, for example, between 3° and 90°, preferably between 5° and 45°. In the fully open position, the opening angle of the door is preferably 90°. The opening angle here is the angle which a substantially planar portion of the door, such as for example a peripheral edge thereof, encloses with the vertical direction.

For opening the door, the receptacle for items to be washed can push indirectly or directly against the door. With direct pushing, the receptacle for items to be washed pushes directly, for example with its front face, against the inner face of the door, i.e. in particular directly against the door inner panel. With indirect pushing, the receptacle for items to be washed pushes against the door inner panel by means of a further component. The further component can be, for example, a damping element or a slider, as explained below in more detail.

The deployment direction and/or the retraction direction can be oriented horizontally, even exclusively horizontally. Alternatively, the deployment direction and/or the retraction direction can describe a curve. This is when the drive moves the receptacle for items to be washed out of the dishwasher cavity or into the dishwasher cavity by means of parallelogram linkages, or the like.

In particular, the household dishwasher can have a plurality of receptacles for items to be washed and/or a plurality of drives.

According to one embodiment, the door has an open position with a predetermined opening angle at the end of the opening movement implemented by the drive and/or at the start of the closing movement implemented by the drive.

"Predetermined" is understood to mean here that the opening angle is not arbitrary but is predetermined by the mechanism, electronics, etc. This also means that the opening angle is always the same over the operating period of the household dishwasher, unless it is provided to be adjustable, as described in more detail hereinafter.

In other embodiments, it is also possible that the opening angle is not predetermined. In particular, the (also predetermined) opening angle can be different at the end of the opening movement and at the start of the closing movement. In other words, the door is opened by means of the receptacle for items to be washed as far as a first opening angle of 10 degrees, for example, and is closed by means of the receptacle for items to be washed at a second opening angle of 30 degrees, for example.

A "receptacle for items to be washed" is understood to mean in the present case a receiver for items to be washed, for example plates, cups, glasses or pans. The receptacle for items to be washed can be configured, in particular, as an upper basket, as a lower basket or as a cutlery tray.

According to a further embodiment, the household dishwasher has a control unit which is set up to activate the drive for moving the receptacle for items to be washed in the deployment direction until the door has the predetermined opening angle.

"Activate" can also encompass a closed-loop control. The closed-loop control can have, for example, a sensor (or even a plurality of sensors) which, in particular, detects the actual opening angle. The control unit compares the actual opening angle with the predetermined opening angle and activates the drive until the actual opening angle corresponds to the predetermined opening angle. When closing the door, the control unit activates the drive for moving the receptacle for items to be washed in the retraction direction until the door has passed from its start position (the at least partially open position) into its closed position. A corresponding closed-loop control can also be provided here.

According to a further embodiment, the household dishwasher has an input facility which is set up to receive a user input. The control unit is designed to set the predetermined opening angle by means of the drive as a function of the user input.

The input facility is, for example, an operating element such as for example a switch, a rotary knob, a touch display or a (for example wireless-/network-) communication interface. The communication interface can be set up to receive the user input from an external device, such as for example a smartphone.

According to a further embodiment, the predetermined opening angle is adjustable between at least a first value and a second value.

The adjustment between the at least one first and second value can be implemented, for example, in the factory of the manufacturer of the household dishwasher or by a user of the household dishwasher. As a result, the opening angle can be adapted in a simple manner to the respective requirements. For example, for ergonomic reasons some users will prefer a larger opening angle than other users.

According to a further embodiment, the first value and/or the second value can be set by a user mechanically, pneumatically, hydraulically and/or electronically.

In particular, the electronic setting can be carried out in a simple manner via the already mentioned input facility, in particular by means of an operating element.

According to a further embodiment, the household dishwasher comprises a data memory in which the predetermined opening angle or the first value and/or the second value is stored.

For example, the first value can be a basic setting which is already input into the data memory in the factory. However, the second value can be set by a user, for example. Different data memories can also be used for the first and second value, wherein for example the data memory for the first memory is a read-only data memory. As a result, the basic setting can be stored, for example, in an unchangeable manner.

According to a further embodiment, the household dishwasher has a calculation unit which is set up to calculate the predetermined opening angle or the first value and/or the second value and optionally to store it on the data memory.

According to a further embodiment, the calculation unit is set up to compute the predetermined opening angle or the first value and/or the second value as a function of simulated data and/or real data.

The calculation unit can have, in particular, an artificial intelligence which is set up to compute the predetermined opening angle or the first value and/or the second value as a function of simulated data and/or real data. "Artificial intelligence" is to be understood to mean in the present case an algorithm or a plurality of algorithms. These algorithms can also comprise, for example, a neural network or a plurality of neural networks, statistical methods, or the like. In particular, the artificial intelligence can have algorithms which have been trained by means of training data (in the factory, i.e. by the manufacturer of the household dishwasher or by the user of the household dishwasher, i.e. by the customer). The training by means of training data can also be carried out over the period of use of the household dishwasher, in particular in situ at the premises of the customer.

"Simulated data" can be obtained, in particular, in two ways: firstly another (in particular the same or comparable) household dishwasher can be provided with a sensor or a plurality of sensors which, for example, observe a behavior of a standard user. The data thus collected is then input, for example, into a data memory of the household dishwasher in the factory and are then available for the calculation unit during the operation of the household dishwasher. However, such data can also be input via a private computer network (LAN, etc.) or a public computer network (WAN, etc.) and namely, in particular, at the place of operation of the household dishwasher (i.e. at the premises of the customer).

"Real data" can be provided, for example, by the household dishwasher having a sensor or a plurality of sensors which are set up, for example, to detect user behavior relative to the household dishwasher. As a result, advantageously an actual behavior of a corresponding user can be detected and used by the calculation unit and empirical values which have been collected with other (standard) users (simulated data) do not have to be used.

According to a further embodiment, the household dishwasher has an upper and lower receptacle for items to be washed. The drive or one respective drive is set up to open the door initially by means of the upper receptacle for items to be washed as far as a first opening angle, and then to open the door by means of the lower receptacle for items to be washed as far as a second opening angle which is greater than the first opening angle.

For example, the first opening angle can be between 5° and 30° and/or the second opening angle can be between 30° and 90°. The upper and lower receptacle for items to be washed can be, in particular, an upper and lower basket. However, the upper receptacle for items to be washed could also be a cutlery tray and the lower receptacle for items to be washed could be a lower basket. As a result, the door can be fully opened in a simple manner.

In particular, it is not excluded that three receptacles for items to be washed or more receptacles for items to be washed or loading levels are provided in the household dishwasher.

In particular, the upper receptacle for items to be washed can be assigned a first drive and the lower receptacle for items to be washed can be assigned a second drive.

According to a further embodiment, a movement of the receptacle for items to be washed by means of the drive in the deployment direction from its fully retracted position is only possible if a facility of the receptacle for items to be washed initially establishes the closed state and/or the unlocked state of the door.

According to a first variant, the household dishwasher has a door lock. This locks the door in the closed state. The receptacle for items to be washed accordingly has to overcome the closing force of the door lock for opening the door. According to a second variant, the household dishwasher comprises a door opening module for the automatic locking and unlocking of the door lock. In this case, the door lock is first unlocked before the receptacle for items to be washed is pushed against the door for the opening thereof. Advantageously, a risk to the user by an opening door can be eliminated or reduced by means of this embodiment since the door only opens if it was previously closed.

The facility is, in particular, a sensor which detects the closed position of the door. Additionally or alternatively, the facility can be the door opening module which outputs a corresponding output signal as a function of the locked state or unlocked state of the door.

According to a further embodiment, the household dishwasher has a coupling facility which, for closing the door, is set up to couple this (the door) releasably to the receptacle for items to be washed.

The coupling facility can be, for example, magnets, a latching mechanism, a slotted track contour, a spring mechanism, etc. Advantageously, the door can be "captured" so that the door is pulled closed by means of the receptacle for items to be washed. Since the door is releasably connected to the receptacle for items to be washed by means of the coupling facility, the door can be opened further beyond the predetermined opening angle during the opening thereof. The decoupling of the door from the receptacle for items to be washed, i.e. in particular a disconnection of the coupling facility, is carried out in advance thereof. The decoupling can be carried out by a user manually pulling the door further open or, for example, the lower receptacle for items to be washed pushing the door further open.

According to a further embodiment, one of the door and the receptacle for items to be washed has a damping element and/or a slider, wherein the damping element and/or the slider is arranged between the receptacle for items to be washed and the door in the closed position of the door and/or the partially open position thereof.

In particular, damage to the door inner face or the receptacle for items to be washed is avoided thereby if they collide, for example during the automatic opening or closing of the door.

According to a further embodiment, the household dishwasher has a control unit which is set up to activate the drive such that it drives the receptacle for items to be washed with variable acceleration.

In particular, the drive merely accelerates the receptacle for items to be washed slowly before it comes into contact with the door, and then more rapidly. Advantageously, a soft start can be implemented thereby, which reduces operating noise and decreases wear.

According to a further embodiment, it is provided that the receptacle for items to be washed is provided to be movable in a linear manner exclusively in the deployment direction and/or the retraction direction.

According to a further embodiment, it is provided that the drive has an electric motor, a mechanism, a pneumatic system and/or a hydraulic system. The mechanism can be, in particular, a spring system.

According to a further embodiment, the drive is set up to move the receptacle for items to be washed by means of a gear mechanism, in particular a gearwheel, which engages in a toothed rack.

The units described in the present case, such as for example the control unit, can be configured by hardware technology and/or software technology.

Further possible implementations of the invention also comprise combinations of features of embodiments which are described above or below relative to the exemplary embodiments and which are not explicitly mentioned. A person skilled in the art will also add individual aspects as improvements or additions to the respective basic form of the invention.

BRIEF DESCRIPTION OF THE DRAWINGS

Further advantageous embodiments and aspects of the invention form the subject matter of the dependent claims and the exemplary embodiments of the invention described hereinafter. The invention is described in more detail hereinafter by way of preferred embodiments with reference to the accompanying figures.

In the figures.

DETAILED DESCRIPTION OF EXEMPLARY EMBODIMENTS OF THE PRESENT INVENTION

Elements which are the same or functionally the same have been provided in the figures with the same reference signs, unless specified otherwise.

Figure 1:
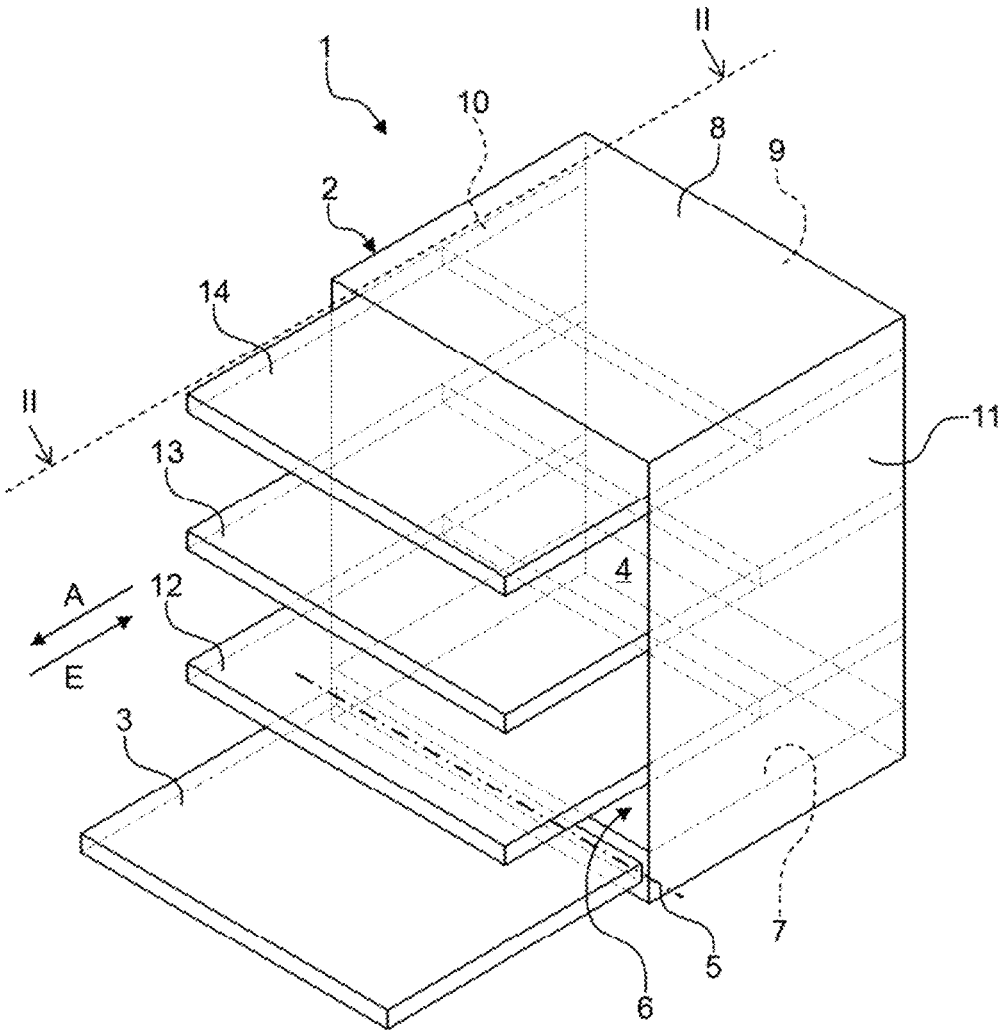
FIG. 1 shows a schematic perspective view of an embodiment of a household dishwasher.

FIG. 1 shows a schematic perspective view of an embodiment of a household dishwasher 1. The household dishwasher 1 comprises a dishwasher cavity 2 which can be closed by a door 3, in particular in a water-tight manner. To this end, a sealing facility can be provided between the door 3 and the dishwasher cavity 2. The dishwasher cavity 2 is preferably cuboidal. The dishwasher cavity 2 can be arranged in a housing of the household dishwasher 1. The dishwasher cavity 2 and the door 3 can form a dishwasher interior 4 for washing items to be washed.

The door 3 is shown in FIG. 1 in its open position. The door 3 can be closed or opened by pivoting about a pivot axis 5 provided at a lower end of the door 3. A loading opening 6 of the dishwasher cavity 2 can be closed or opened by means of the door 3. The dishwasher cavity 2 has a floor 7, a ceiling 8 arranged opposite the floor 7, a rear wall 9 arranged opposite the closed door 3 and two side walls 10, 11 arranged opposite one another. The floor 7, the ceiling 8, the rear wall 9 and the side walls 10, 11 can be produced, for example, from a stainless steel sheet. Alternatively, for example, the floor 7 can be produced from a plastics material.

The household dishwasher 1 also has at least one receptacle for items to be washed 12 to 14. Preferably, a plurality of receptacles for items to be washed 12 to 14, for example three thereof, can be provided, wherein the receptacle for items to be washed 12 can be a lower receptacle for items to be washed or a lower basket, the receptacle for items to be washed 13 can be an upper receptacle for items to be washed or an upper basket and the receptacle for items to be washed 14 can be a cutlery tray. As FIG. 1 also shows, the receptacles for items to be washed 12 to 14 are arranged one on top of the other in the dishwasher cavity 2. Each receptacle for items to be washed 12 to 14 is selectively displaceable into or out of the dishwasher cavity 2. In particular, each receptacle for items to be washed 12 to 14 can be inserted or retracted into the dishwasher cavity 2 in an insertion direction E (also in the present case "retraction direction E"; arrow) and can be pulled out or deployed from the dishwasher cavity 2 counter to the insertion direction E (arrow) in a pull-out direction A (also in the present case "deployment direction A").

Figure 2:
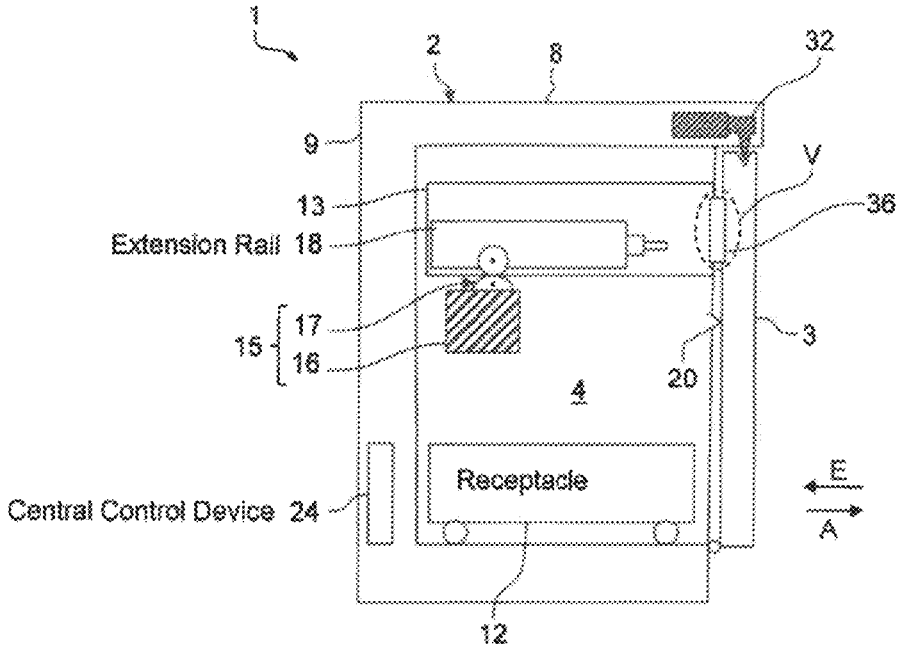
FIG. 2 shows a view II-II of FIG. 1, wherein the door of the household dishwasher is in the closed state thereof.

FIG. 2 shows a section II-II of FIG. 1. By way of example, the household dishwasher 1 has an upper basket 13 which can be deployed automatically out of the dishwasher cavity 2 in the deployment direction A (arrow) and retracted into the dishwasher cavity 2 in the retraction direction E (arrow) (also denoted as the "automatic rack movement"). An apparatus 15 is provided to this end. The apparatus 15 can have a drive in the form of an electric motor 16 and a gear mechanism 17. The gear mechanism 17 can drive a gearwheel or a plurality of gearwheels, not denoted in more detail, and/or a toothed rack. For example, the toothed rack can be fastened to the upper basket 13 and a gearwheel driven by the electric motor 16 engages in the toothed rack, whereby the upper basket 13 can be retracted and deployed. The upper basket 13 is held exclusively in a linearly movable manner, for example, by means of a telescoping extension rail 18 on a dishwasher cavity inner face, not denoted in more detail. The exclusively linear movement takes place in the deployment direction A (arrow) or in the retraction direction E (arrow).

Figure 3:
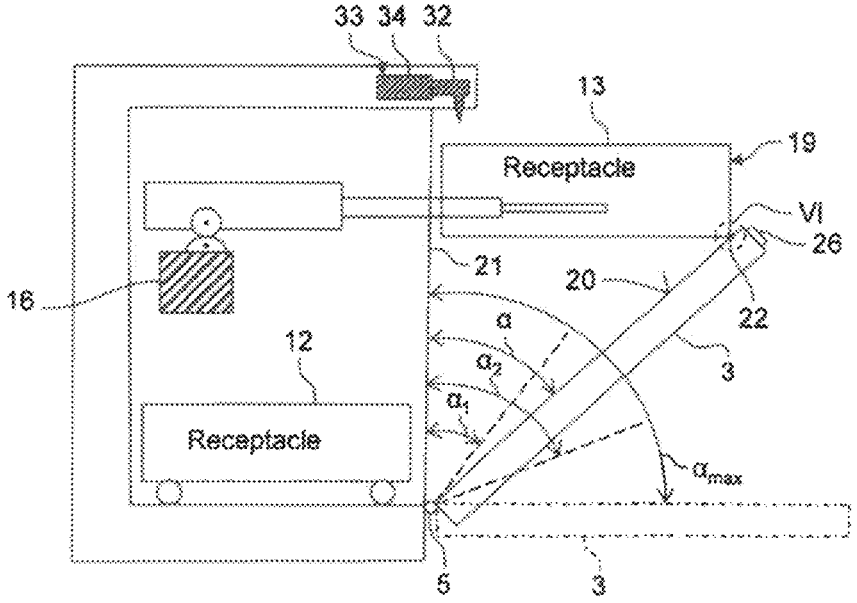
FIG. 3 shows the view of FIG. 2, wherein the door is in the open state thereof.

In the closed position of the door 3 shown in FIG. 2, the electric motor 16 is set up to push the upper basket 13 with its front face 19 (see FIG. 3) against the door inner face 20. If the force applied to the door inner face 20 (i.e. in particular the door inner lining) exceeds a predetermined threshold value, the door 3 is opened, as can be seen in FIG. 3. The resulting opening angle $\alpha$ describes how far the door 3 is opened. The opening angle $\alpha$ is defined between the door inner face 20 and a dishwasher cavity edge 21 running perpendicularly. As can also be identified in FIG. 3, the door 3 opens as wide as it is pushed open by the upper basket 13. This is defined, in particular, where a lower corner 22 (see FIG. 3) on the front face 19 of the upper basket 13 loses contact with the inner face 20 of the door 3.

The opening angle $\alpha$ in a household dishwasher 1 is advantageously predetermined. In embodiments, this opening angle can be set, in particular, between a first and second value $\alpha_1$, $\alpha_2$ (see FIG. 3).

Figure 4:
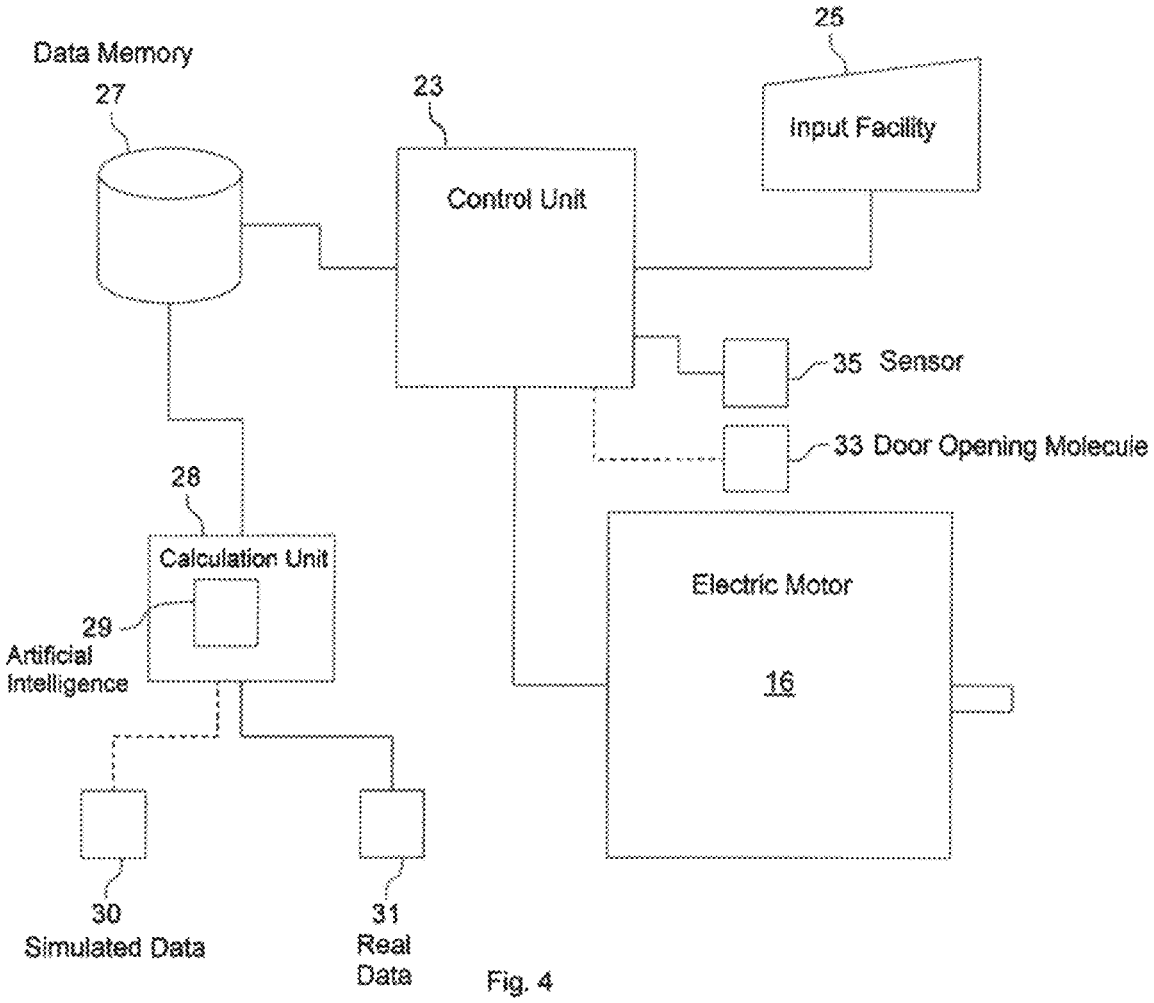
FIG. 4 shows a circuit of the household dishwasher of FIGS. 1 to 3 according to one embodiment.

According to a first embodiment, therefore, the household dishwasher 1 has a control unit 23 shown in FIG. 4. FIG. 4 shows an exemplary circuit of the household dishwasher 1.

The control unit 23 can be configured, for example, as a microprocessor. This is particularly advantageous if the control unit 23 is provided separately from a central control device 24 (see FIG. 2) of the household dishwasher 1. For example, the controller for the pumps and valves of the household dishwasher 1 is provided on the central control device 24.

The control unit 23 can also be configured (purely) by software technology on the central control device 24. The control unit 23 is set up to activate the electric motor 16 until the door 3 has the predetermined opening angle $\alpha$. In the region of its pivot axis 5, the door 3 can be coupled by means of a brake (not shown) to the body 2 of the household dishwasher 1. This brake can be set up to prevent a further (inadvertent) pivoting open of the door 3 when the door has the predetermined opening angle $\alpha$.

Moreover the household dishwasher 1 can have an input facility 25 (see FIG. 4) for receiving a user input. The input facility 25 can be integrated, for example, in a control panel 26 on the front face or the outer face of the door 3 or on the upper narrow side thereof (see FIG. 3), also by software technology. For example washing programs of the household dishwasher 1 can be selected via the control panel 26.

A user (also denoted as the operator) can input the desired predetermined opening angle $\alpha$ by means of the input facility 25. Alternatively, however, in embodiments the user can select a specific mode, for example comfort mode, for which a predetermined opening angle $\alpha$ is stored in a data memory 27 (see FIG. 4). If the comfort mode is selected, the control unit 23 activates the electric motor 16 with the opening angle $\alpha$ read from the data memory 27.

Moreover, it can be provided that the user can adjust the predetermined opening angle $\alpha$ between a first and second value $\alpha_1$ and $\alpha_2$, for example for comfort reasons. For example, the angle $\alpha_1$ can be an angle (basic position) already stored in the data memory 27 in the factory. If the user wishes to set a different opening angle $\alpha_2$, the user can set this opening angle by means of the input facility 25. This opening angle is then also input into the data memory 27, for example. According to the exemplary embodiment, the first and second values $\alpha_1$, $\alpha_2$ of the predetermined opening angle $\alpha$ are set electronically by the user. This could also be carried out mechanically, pneumatically or hydraulically, however.

FIG. 4 shows a further embodiment in which the household dishwasher 1 has a calculation unit 28. The calculation unit 28 is set up to calculate the predetermined opening angle $\alpha$ or the first value $\alpha_1$ and/or the second value $\alpha_2$ and optionally to store it in the data memory 27. The calculation unit 28 has an artificial intelligence 29, for example in the form of a neural network. The artificial intelligence 29 is trained with simulated data 30 (indicated in dashed lines in FIG. 4) or with real data 31 (or both types of data 30, 31). The simulated data 30 can correspond, for example, to simulated user behavior. However, the real data 31 can correspond to actual user behavior. The simulated data 30 can be provided, for example, via a public network, in particular the internet. The real data 31 is detected, for example, by means of a sensor or a plurality of sensors (not shown) in the household dishwasher 1.

Embodiments are now described by way of FIGS. 2 and 3 which can result, on the one hand, from the household dishwasher 1 having a door lock 32 without an assigned actuator (see FIG. 2). On the other hand, in the embodiment according to FIG. 3 a door lock 32 which is part of a door opening module 33 is present. The door opening module 33 comprises, in particular, a wax motor 34 (or another actuator) which activates the door lock 32 for locking or unlocking the door 3.

In the case of FIG. 2 (only one door lock 32 is present) the door 3 is opened by the electric motor 16 or the upper basket 13 overriding the door lock 32 in its locked position. As a result, this door lock is automatically unlocked. Before the upper basket 13 is actuated for opening the door 3, however, it is preferably ensured that the door 3 is also in its closed position. A sensor 35 (see FIG. 4), which detects the closed position of the door 3, is provided to this end. This reduces or avoids the risk that the upper basket 13 is deployed and, for example, squashes a hand located between its front face 19 and the door inner face 20.

In the exemplary embodiment according to FIG. 3 (door lock 32 with, for example, a wax motor 34 or another actuator) the door opening module 33 is read by the control unit 23. This variant is indicated in dashed lines in FIG. 4. The door opening module 33 provides information about the locked or unlocked position of the door lock 32. Accordingly, in this variant it can also be provided that the door is opened by means of the upper basket 13 only when the door is actually in its closed position.

Figure 5:
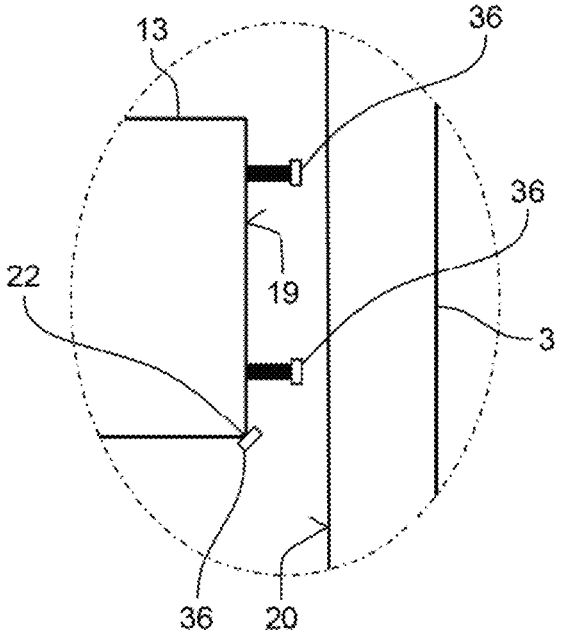
FIG. 5 shows an enlarged view V of FIG. 2.

FIG. 5 shows an enlarged view V of FIG. 2. It is illustrated therein that a damping element or a plurality of damping elements 36 is/are provided between the front face 19 of the upper basket 13 and the inner face 20 of the door 3 (here by way of example three thereof, wherein a greater or lower number thereof can be provided however). One of the damping elements 36 is provided, for example, on the lower corner 22 of the upper basket 13. The damping elements 36 can comprise, for example, an elastomer. The damping elements 36 damp an impact between the upper basket 13 and the door 3. Such an impact occurs, in particular, when the door 3 is pushed open by means of the upper basket 13. For example, a manual closing of the door 3 can also result in such an impact.

Figure 6:
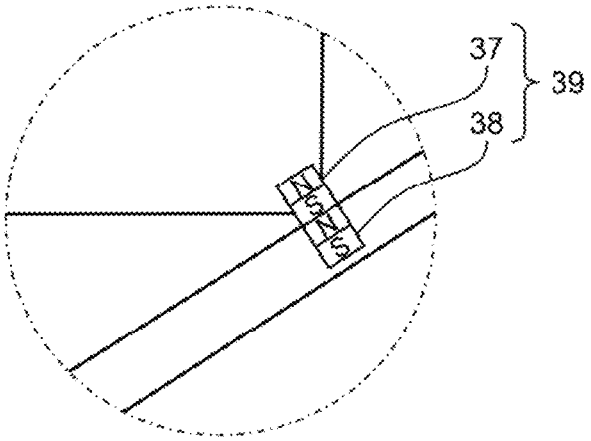
FIG. 6 shows an enlarged view VI of FIG. 3.

FIG. 6 shows an enlarged view VI of FIG. 3. In contrast to FIG. 5, no damping element 36 is provided on the lower corner 22 of the upper basket 13 but rather a first magnet 37 of two magnets 37, 38 of a coupling facility 39. The second magnet 38 of the coupling facility 39 is fastened into or onto the door 3 (in particular onto the door inner face 20). If the magnets 37, 38 come into contact with one another, the coupling facility 39 is in the coupled state and enables the door 3 to be closed by means of the upper basket 13. This is implemented, in particular, at the predetermined opening angle α. To this end, the electric motor 16 actuates the gear mechanism 17, whereby the upper basket 13 is retracted in the retraction direction E (arrow).

Figure 7:
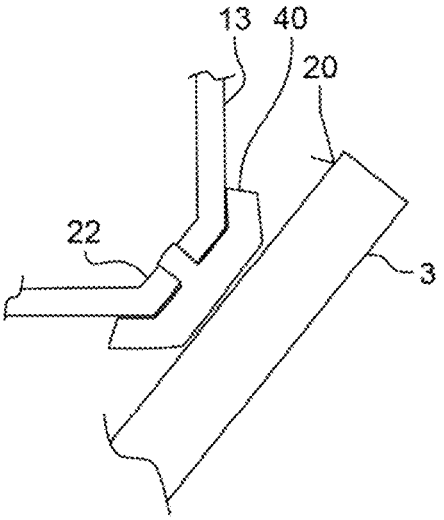
FIG. 7 shows a variant relative to FIG. 6.

FIG. 7 shows a slider 40 instead of the damping element 36 on the lower corner 22 of the upper basket 13. The slider 40 is set up to slide along the door inner face 20. As a result, a hard impact is also prevented between the upper basket 13 and the door 3 and a virtually silent sliding therebetween is ensured during the course of the opening movement.

Figure 8:
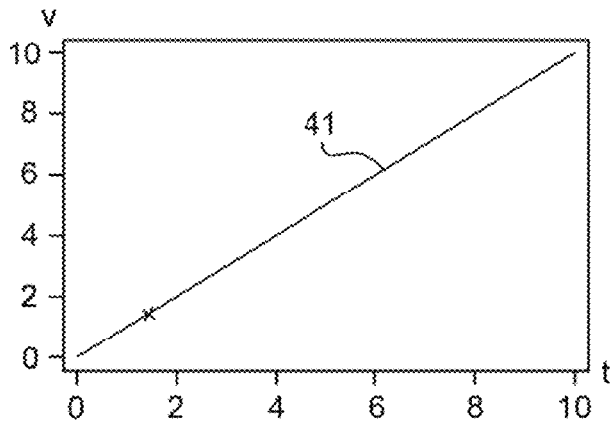
FIG. 8 shows a speed-time diagram of a rack of the household dishwasher.
Figure 9:
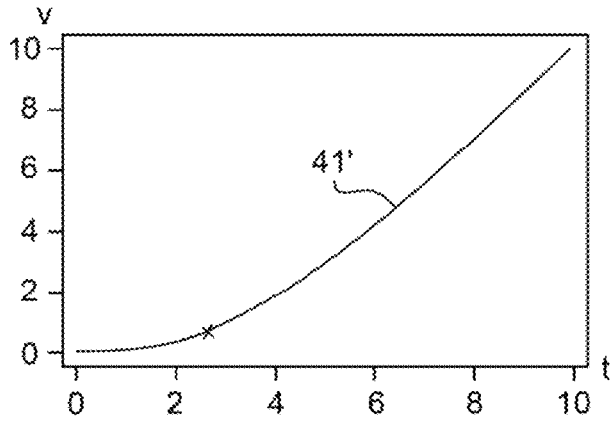
FIG. 9 shows a speed-time diagram according to a variant.

FIG. 8 shows a first speed-time diagram for the upper basket 13, wherein the speed curve 41 is constantly linear (constant gradient). The time is denoted here by t and the speed is denoted by v. FIG. 9 shows accordingly a speed curve 41' which corresponds to a soft start.

At the point identified in each case by a cross in FIGS. 8 and 9, the upper basket 13 comes into contact with the door 3, but at a reduced speed in FIG. 9 due to the soft start. As a result, damage to the door 3, in particular the metal inner face 20 thereof, is avoided.

Alternatively or additionally, a gentle braking of the upper basket 13 could be provided, in particular before it comes into contact with the door 3.

In a further embodiment, not shown in detail, the lower basket 12 (see FIG. 3) is also provided with a drive (not shown). By means of the drive the lower basket 12 can be also deployed in the deployment direction A (arrow) or retracted in the retraction direction E (arrow). The control unit 23 is set up such that it activates the drive 16 such that the drive initially deploys the upper basket 13 until the door has an opening angle α as can be seen in FIG. 3. Then the control unit 23 activates the drive of the lower basket 12 and pushes the door 3 fully open thereby, as illustrated by the door 3 shown in dashed lines in FIG. 3 and the maximum opening angle $\alpha_{max}$. For example, the angle α in this case is 450 and the angle $\alpha_{max}$ is 90°.

While the present invention has been described by way of exemplary embodiments, it can be modified in many different ways.

For example, the lower basket 12 can be pivoted upwardly out of the dishwasher cavity along a curve by means of the drive assigned thereto.

The drive 16 can have a mechanism, in particular a spring, a pneumatic system or a hydraulic system, instead of an electric motor.

The invention claimed is:

1. A household dishwasher, comprising:

a dishwasher cavity;

a door designed to close off or open the dishwasher cavity;

a receptacle for an item to be washed; and a drive designed to move the receptacle in a deployment direction to at least partially open the door and/or a retraction direction to at least partially close the door, wherein the drive is designed to move the door in an opening movement to an open position with a predetermined opening angle at an end of the opening movement and/or at a start of a closing movement.

2. The household dishwasher of claim 1, further comprising a control unit designed to activate the drive for moving the receptacle in the deployment direction until the door has the predetermined opening angle.

3. The household dishwasher of claim 2, further comprising an input facility designed to receive a user input, said control unit designed to set the predetermined opening angle via the drive as a function of the user input.

4. The household dishwasher of claim 1, wherein the predetermined opening angle is adjustable between a first value and a second value.

5. The household dishwasher of claim 4, wherein at least one of the first and second values is adjustable by a user mechanically, pneumatically, hydraulically and/or electronically.

6. The household dishwasher of claim 4, further comprising a data memory designed to store the predetermined opening angle or at least one of the first and second values.

7. The household dishwasher of claim 4, further comprising a calculation unit designed to calculate the predetermined opening angle or at least one of the first and second values.

8. The household dishwasher of claim 7, wherein the calculation unit comprises an artificial intelligence designed to compute the predetermined opening angle or at least one of the first and second values as a function of simulated data and/or real data.

9. The household dishwasher of claim 1, wherein the receptacle comprises an upper receptacle and a lower receptacle, said drive er drives assigned to the upper and lower receptacles being designed to open the door initially via the upper receptacle up to a first opening angle, and then to open the door via the lower receptacle up to a second opening angle which is greater than the first opening angle.

10. The household dishwasher of claim 1, wherein the drive is designed to enable a movement of the receptacle in the deployment direction from a fully retracted position only when a facility of the household dishwasher initially establishes a closed state and/or an unlocked state of the door.

11. The household dishwasher of claim 1, further comprising a coupling facility which, for closing the door, is designed to couple the door releasably to the receptacle.

12. The household dishwasher of claim 1, wherein the door or the receptacle comprises a damping element and/or a slider, with the damping element and/or the slider being arranged between the receptacle and the door in a closed position of the door and/or a partially open position thereof.

13. The household dishwasher of claim 1, further comprising a control unit designed to activate the drive such that the drive drives the receptacle with variable acceleration.

14. The household dishwasher of claim 1, wherein the receptacle is designed for movement in a linear manner exclusively in the deployment direction and/or the retraction direction and/or the drive comprises an electric motor, a mechanism, a pneumatic system and/or a hydraulic system and/or the drive is designed to move the receptacle via a gear mechanism.

15. The household dishwasher of claim 14, wherein the gear mechanism comprises a toothed rack and a gear wheel, which engages in the toothed rack.

* * * * *